United States Patent [19]

Midzutani et al.

[11] 4,148,426

[45] Apr. 10, 1979

[54] METHOD AND APPARATUS FOR MANUFACTURING METAL PIPE

[75] Inventors: Wataru Midzutani, Kitakyushu; Toshio Kikuma, Mizumaki; Koe Nakajima, Nakama; Seiichi Sasahira, Kitakyushu, all of Japan

[73] Assignee: Nippon Steel Corporation, Tokyo, Japan

[21] Appl. No.: 829,464

[22] Filed: Aug. 31, 1977

[30] Foreign Application Priority Data

Sep. 10, 1976 [JP] Japan ..... 51-109189

[51] Int. Cl.[2] ..... B23K 31/06; B21D 39/02; B21D 51/00

[52] U.S. Cl. ..... 228/146; 72/51; 72/368; 113/116 UT; 228/151

[58] Field of Search ..... 72/51, 52, 176, 368, 72/416; 113/116 UT; 228/17, 17.5, 146, 147, 151

[56] References Cited

U.S. PATENT DOCUMENTS

| | | | |
|---|---|---|---|
| 1,973,680 | 9/1934 | Bumbaugh | 228/16 |
| 3,001,569 | 9/1961 | Gradt | 72/176 |
| 3,474,522 | 10/1969 | Rowell | 228/147 |
| 3,945,552 | 3/1976 | Tobita et al. | 228/17.5 |

FOREIGN PATENT DOCUMENTS

| | | | |
|---|---|---|---|
| 185471 | 10/1936 | Switzerland | 72/51 |
| 809874 | 3/1959 | United Kingdom | 72/368 |

*Primary Examiner*—E. M. Combs

*Attorney, Agent, or Firm*—Wenderoth, Lind & Ponack

[57] ABSTRACT

A method and apparatus for manufacturing metal pipe. The edges of a metal plate are bent up slightly, and the thus bent plate is then bent into a U-shape cross-section blank. The U-shape blank is finish-formed into an O-shaped blank with the longitudinal edges opposed to each other in a position for welding by placing one end of the U-shaped blank into at least one two-part die the parts of which are movable toward and away from each other. The die has at least one portion with the shape of the opposed die recesses defining a reforming area on one end of the die portion which has an O-shaped cross-section, a finish forming area in the middle of the length of the die portion having an O-shaped cross-section, these O-shaped cross-sections being the shape of the O-shaped blank, and a transitional area at the other end of the die portion having a cross-sectional shape which changes gradually from an O-shape adjacent the finish forming area to an oval shape elongated in the direction of movement of the die parts at the other end of the die portion. The transitional area is relatively short as compared to the remainder of the die parts. This one die portion is shorter than the length of the blank. The U-shaped blank is placed in the die with the elongated dimension of the cross-section corresponding to the elongated dimension of the oval shape and with one end of the blank at the one end of the die portion, and the two part die is closed for shaping the U-shaped blank into a blank having an O-shaped cross-section reformed portion on said one end of the blank, a finished O-shaped cross-section and a transitional section. The two part die is opened and the thus formed blank along the die until the edge of the transitional section of the blank is at the end of the finished forming area of the die portion adjacent the reforming area. The steps of positioning the blank and opening and closing the die are repeated until the blank is completely formed into an O-shaped cross-section, and the opposed edges of the plate are then welded to produce the O-shaped cross-section blank.

9 Claims, 18 Drawing Figures

PLATE
IA
2
IB
CRIMPING
IC
U-FORMING
ID
O-FORMING
IW
INSIDE WELDING
OW
OUTSIDE WELDING
EXPANDING 21
22
23
24
25
26
27
IV
IV 25
26
27

11
12
13
IB 15
16
17
18
19
IC

METHOD AND APPARATUS FOR MANUFACTURING METAL PIPE

BACKGROUND OF THE INVENTION

This invention relates to a method and apparatus for manufacturing metal pipe and more particularly to a cold forming method and apparatus for manufacturing submerged arc welding pipe using a skelp or a plate as the blank.

Heretofore, in manufacturing submerged arc welded pipe from a skelp or plate, for example, in the so-called UOE system of forming a large diameter pipe, a plate initially has both edge portions bent to form the plate into a shallow wide trough by being pressed between a top die having convex curved surface and a bottom die having concave surface.

Next, the center portion of the plate is bent in almost a U-shape cross-section by a top U-shape punch of the single cylinder type or double cylinder type and a pair of rotary rocker type dies disposed on the left and right sides of the plate which cooperate to folding the plate with a U-shape cross-section blank.

Thereafter, the U-shaped blank is fed into the space between top and bottom dies defining an O-shape and the gap between the top and bottom dies is gradually reduced whereby the blank is shaped as it moves along the inner surface of the dies and finally compression is applied in the peripheral direction of the blank so that the blank is formed into an O-shaped cross-section and then the inside and outside surfaces are welded at the abutting edges of the blank and the thus formed cylinder is expanded to become a finished pipe.

In the conventional forming method, the following problems arise.

(1) In general, the bending into the U-shape can be carried out with relatively small force, but during the shaping into the O-shape cross-section, the cross section of the blank becomes polygonal in the initial period of the forming, and when forming a high tension and large wall thickness steel pipe having a plate thickness greater than 35 mm, with presently available press capacity (50,000–60,000 ton), forming of the polygonal shape into a round shape is difficult. Particularly, the area around the longitudinal edges is hard to shape into good roundness, and this deficiency cannot be corrected sufficiently during the succeeding expanding step.

(2) In general, in the shaping into the O-shaped cross-section, where the compression is applied in the direction of periphery of the pipe, the load P necessary for obtaining a satisfactory shape is about 2–3 times the load applied at the moment of full contact of the blank and the inner surface of the die as will be described hereinafter, and it is represented by the following equation, $$P = 1.15\ \delta y.2t.1 \qquad (1)$$

where $\delta y$: yield strength of the blank (kg/mm$^2$)

t: plate thickness of the blank (mm)

l: length of the blank (mm)

Since this load is proportional to the plate thickness and pipe length and yield strength of the blank, it becomes extremely large if the plate thickness and the length of the pipe become large, and in case of large wall thickness high tension steel pipe having a yield strength of 52 kg/mm$^2$ and a plate thickness of 40 mm and a length of 18 m, the load required for the forming is 86,000 tons which requires a huge press forming machine.

Also, in forming a long heavy gauge pipe, after the edge bending and rough U-shaped forming by a press machine having a relatively small capacity, forming by the O-shape die which has a short length takes place, but the shape is not necessarily stabilized, and in order to prevent die marks which tend to occur in the forming process, a tremendous amount of time and a number of forming steps are required making it extremely difficult to manufacture pipe economically.

SUMMARY OF THE INVENTION

An object of the present invention is to provide a novel UO type pipe forming method and apparatus which solves the problem of the forming technique for present heavy gauge high tension long steel pipe as described in the foregoing, and reduces the forming load necessary for the process of forming the long cylindrical pipe from a skelp or a plate, and makes it possible to making quality of the welded portion of the pipe by making the shape of the pipe, particularly the shape of the pipe near the abutting edge portions approach true roundness, thereby improving productivity by eliminating the need for a correcting operation by expanding or other methods, and increases the range of sizes which can be manufactured.

In order to achieve the foregoing object, the method of manufacturing metal pipe according to the present invention comprises the steps of bending the edges of a metal plate up slightly, further bending the thus bent plate into a U-shape cross-section blank, finish forming the U-shape blank into an O-shaped blank with the longitudinal edges opposed to each other in position for welding by placing one end of the U-shaped blank into at least one two-part die the parts of which are movable toward and away from each other and having at least one portion with the shape of the opposed die recesses defining a reforming area on one end of the die portion which has an O-shaped cross-section, a finish forming area in the middle of the length of the die portion having an O-shaped cross-section, said O-shaped cross-sections being the shape of the O-shaped blank, and a transitional area at the other end of the die portion having a cross-sectional shape which changes gradually from an O-shape adjacent the finish forming area to an oval shape elongated in the direction of movement of the die parts at the other end of the die portion, the transitional area being relatively short as compared to the remainder of the die parts, said at least one die portion being shorter than the length of the blank, the U-shaped blank being placed in the die with the elongated dimension of the cross-section corresponding to the elongated dimension of the oval shape and with one end of the blank at said one end of said die portion, closing the two part die by moving the parts toward each other for shaping the U-shaped blank into a blank having an O-shaped cross-section reformed portion on said one end of the blank, a finished O-shaped cross-section and a transitional section, opening the two-part die by moving the parts away from each other, moving the thus formed blank along the die until the edge of the transitional section of the blank is at the end of the finished forming area of the die portion adjacent the reforming area, again closing the die, repeating the steps of positioning the blank and opening and closing the die until the blank is completely formed into an O-shaped cross-section, and welding the opposed edges of the plate to produce the O-shaped cross-section blank.

DESCRIPTION OF THE PREFERRED EMBODIMENT

In manufacturing metal pipe (cylindrical pipe) by the present invention, a skelp or plate is used as the starting material. The plate is not formed initially into a cylindrical pipe by a multistep forming method by a single die or a plurality of dies or a plurality of presses according to the present invention. Normally, the plate is initially formed into a U-shape cross-section by a series of forming steps to be described hereinafter, and then it is formed into the cylindrical pipe by a multistep forming method by a combination of the O-shape forming dies including a rough O-shape forming die and a transitional forming die portion according to the present invention, or by the multistep forming method by finished O-shape die which includes a transitional forming die portion.

First a summary of the prior art process for making welded pipe from a plate will be described referring to FIG. 1.

The plate (1A) has the edges bent up in order to prevent abrasion of the dies and to impart a good roundness to the finished pipe. The edge bending is carried out by a crimping machine (11) for forming the plate (1B) into a wide trough as shown in FIG. 2. The crimping machine (11) is provided with a top die (12) a convex curved surface and a bottom die (13) having a concave curved surface, and both edge portions (2) of the plate (1B) are pressed between the top die (12) and bottom die (13) and are bent.

Figures 1, 2, 3, 4A, 4B:
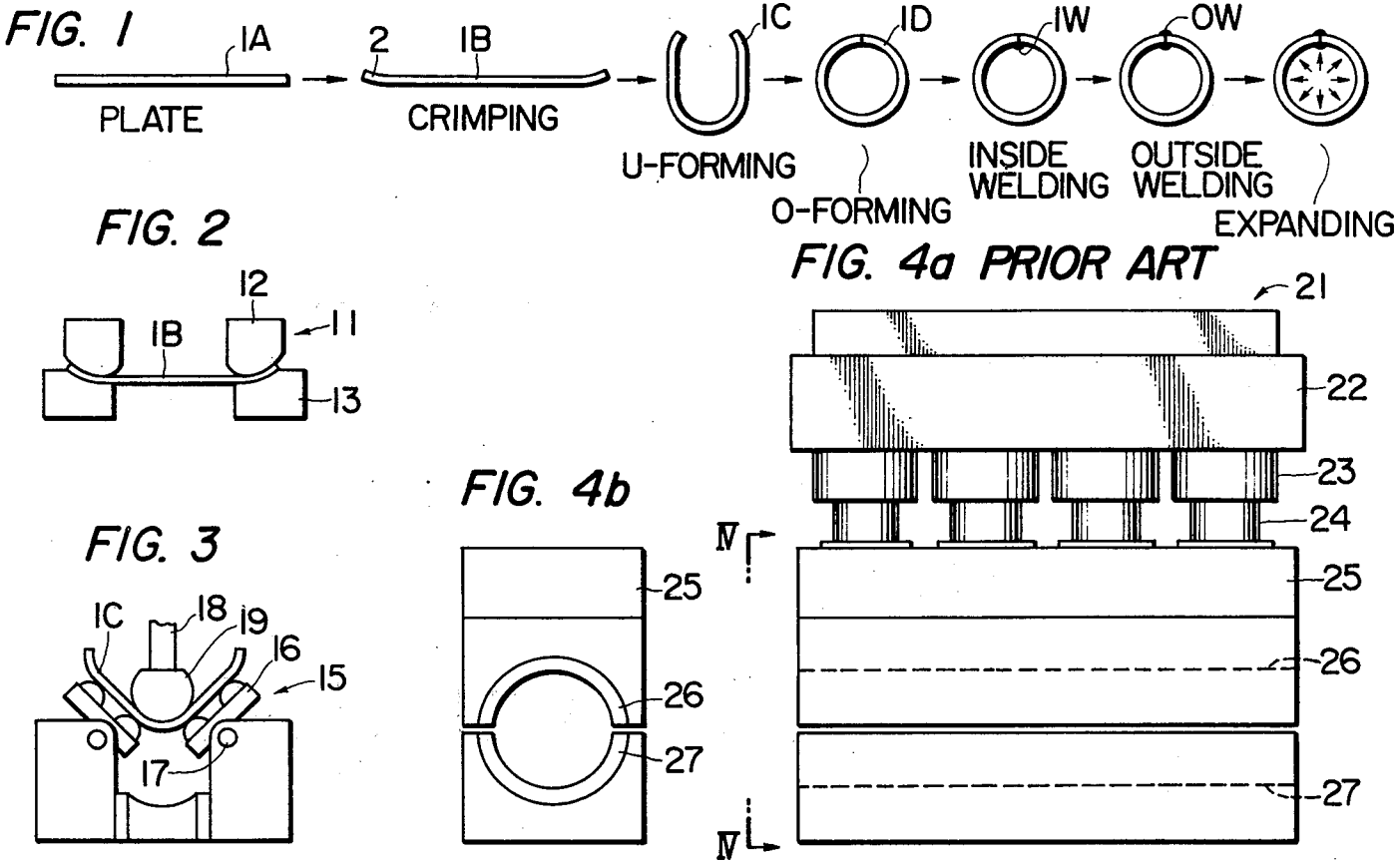
FIG. 4a PRIOR ART
FIG. 1 is a diagramatic view of the steps in the process of manufacturing a metal pipe from a plate.
FIG. 2 is a schematic drawing of an edge bending machine employed in the foregoing process.
FIG. 3 is a schematic drawing of a press for bending the plate into a U-shaped cross-section employed in the foregoing process.
FIG. 4*a* is a side elevation showing a press with a conventional die for shaping the blank into an O-shaped cross-section.
FIG. 4*b* is a front elevation of the die taken along line IV—IV of FIG. 4*a;*

The edge bent plate (1B) is formed into blank having a U-shape cross-section by the U-shape forming press (15) as shown in FIG. 3. In the press (15), the edge bent plate (1B) has its left and right sides supported by a rocker type die (16) having two parts rockable around pivot shafts (17), and the center portion of the plate is pressed down by a ram (18) having a with a U-shape cross-section and is bent into the U-shape.

The U-shaped blank (1C) is formed into an O-shaped cross-section blank as will be described hereinafter. Then, the O-shape cross-section blank (1D) is expanded by an expanding machine after the seam along the abutting edges is welded at (1W) on the inside and at (0W) on the outside.

FIGS. 4*a* and 4*b* show a press which has been used in the conventional method of forming the O-shape cross-section. The press (21) is provided with a plurality of hydraulic cylinders operated by an oil pressure unit (22), and at the bottom end of the rams (24) of oil pressure cylinders (23) is mounted a platen (25). A top die (26) having semicircular cross section is mounted on the bottom of the top platen. A semicircular die (27) is mounted opposite to the top die (26).

Figure 5:
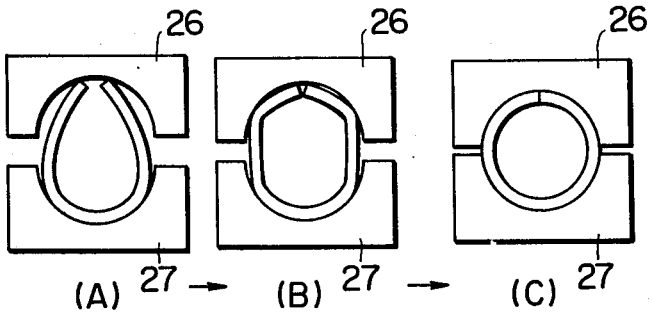
FIGS. 5*a*–5*c* are schematic drawings showing the change in the cross sectional shape of the U-shaped blank from the U-shape to an O-shape during the forming into the O-shaped cross-section.
Figure 6:
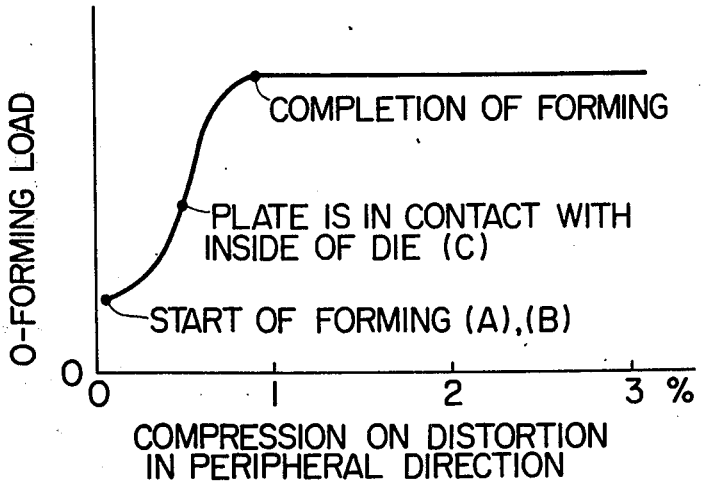
FIG. 6 is a graph showing the relationship between the compression strain in the peripheral direction and the forming load during the forming into the O-shaped cross-section.

As described in the foregoing, the U-shaped blank is inserted into the space between the top die (26) and bottom die (27) with both edges extending upward, and while the top die (26) is slowly pushed down, the blank has a uniform forming pressure applied along the entire length thereof and is formed into an O-shape cross-section. During the process wherein the blank is changed from the U-shape cross-section into the O-shape cross-section, the cross-sectional shape changes sequentially as shown in FIGS. 5A, 5B and 5C. FIG. 5A shows the condition where the U-shaped blank inserted between the dies (26) and (27) has been pressed slightly, and the FIG. 5B shows the condition where the lower half portion of the blank is in tight contact with almost half the circumference of the bottom die (27), and the FIG. 5*c* shows the condition where the formed blank is in tight contact with the entire forming into the O-shape cross-section is completed. In the forming process the relation condition where the O-forming is completed. In the process of the O-forming, FIG. 6 is a graph showing the relationship between the compression strain generated on the formed blank and the load for carrying out the forming is as shown in FIG. 6. The symbols (A), (B) and (C) on the drawing correspond respectively to the parts of FIG. 5. As will be obvious from this graph, a large forming load is required to bring about the tight contact of the formed blank with the dies to complete the forming into the O-shaped cross-section. This shows that for the conventional method, as described in the foregoing, a huge press is required.

Figure 7:
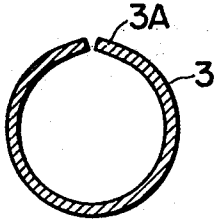
FIG. 7 PRIOR ART
FIG. 7 is a cross section of the O-shaped blank which is formed by the conventional method.

Also, in the conventional method where the thickness of the plate being formed is large, as shown in FIG. 7, in the vicinity of the portion (3A) of the O-shaped blank (3) the blank is not sufficiently rounded by the inner peripheral surface of the die due to insufficient capacity of the press, and the shape is somewhat flat, and accordingly, the O-shaped blank (3) does not have the desired roundness. Even though this deficiency tends to be corrected by the expanding step, a finished pipe having the proper shape is difficult to obtain.

Next, the method of forming the U-shaped blank into an O-shaped blank according to the present invention will be described, and in the present invention, although the basic technique is common to all the embodiments, there are four different forming method which are mutually slightly different, namely, single die system, a double die system, a double press system and a divided die press system. These methods will be described sequentially in the following.

Figure 8A:
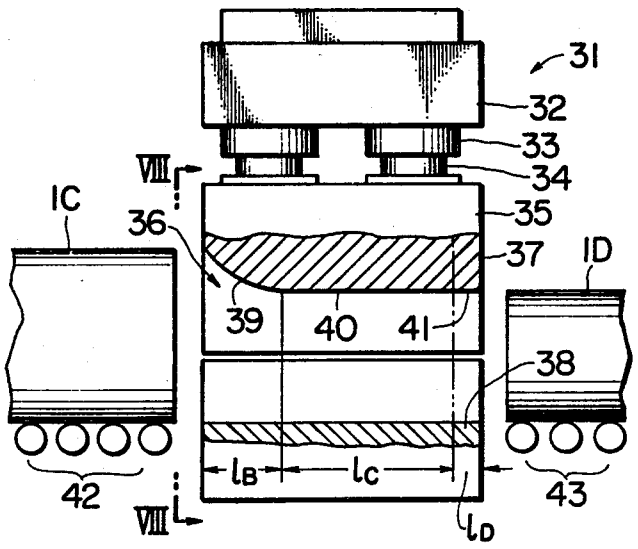
FIG. 8*a* is a side elevation, partly in section, showing one embodiment of the press according to the present invention for forming the U-shaped blank into an O-shape cross-section.
Figure 8B:
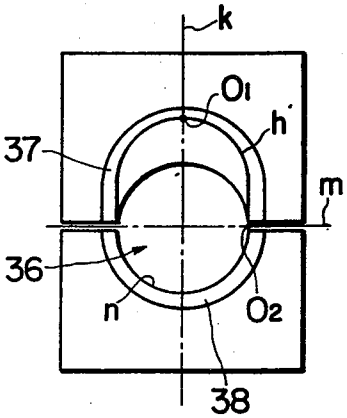
FIG. 8*b* is a front elevation view taken along the line VIII—VIII of FIG. 8*a;*

FIGS. 8*a* and 8*b* show the press for the single die system. The press (31) resembles a conventional press (21) as shown generally in FIG. 5, and is composed of and oil pressure unit (32), oil pressure cylinders (33), rams (34), platen (35) and die (36). However, as compared with the prior art press (21) as shown in FIG. 4, the length of the die (36) is short. The die (36) is composed of a transitional forming area (39) in which the surface of the top die (37) is smoothly curved toward the exit end from the incoming end of the die (36) from a cross-section which is of oval to a cross-section which is circular, a finish forming area 40 the cross-section of which is circular, and a re-forming area (41) having a cross section identical with that of the finish forming area (40).

The transitional forming area (30) of die 36 has a length (lB) which is about 0.1 to 3.0 times the diameter of the finished pipe. The taper of contour lines defining the surface of the top die 37 from the front to the rear decreases from a contour line at the point $0_1$ at the intersection of a vertical center line k through the cross section of the front end of die 36 and a line h around the periphery of the cross section of the top die 37 to a contour line at the point $0_2$ at the intersection of a horizontal center line m through the cross section of the die 36 and the peripheral line h. The taper of the contour line extending from the point $0_1$ relative to the longitudinal center line of the die is about 1/5 to ⅓. The peripheral line n of the bottom die 38 is a semi-circle, and accordingly, the cross section of the die (36) is oval as described in the foregoing.

The finish forming area (40) of the die (36) is circular in shape, and the exit end of the transitional forming are (39) is merged smoothly into the inlet end of the finish forming area (40). The length (lc) of the finish forming area is appropriately about ½ to ¼ of the length of the pipe. The length (ld) of the re-forming area (41) is about 0.3–1.0 times the diameter of the finished pipe.

Furthermore, a roller table (42) for advancing the U-shaped blank (1C) intermittently is disposed at the incoming end of the press (31) and a roller table (43) for carrying the O-shaped blank (ID) out of the press (31) is disposed at the exit end.

Figure 9:
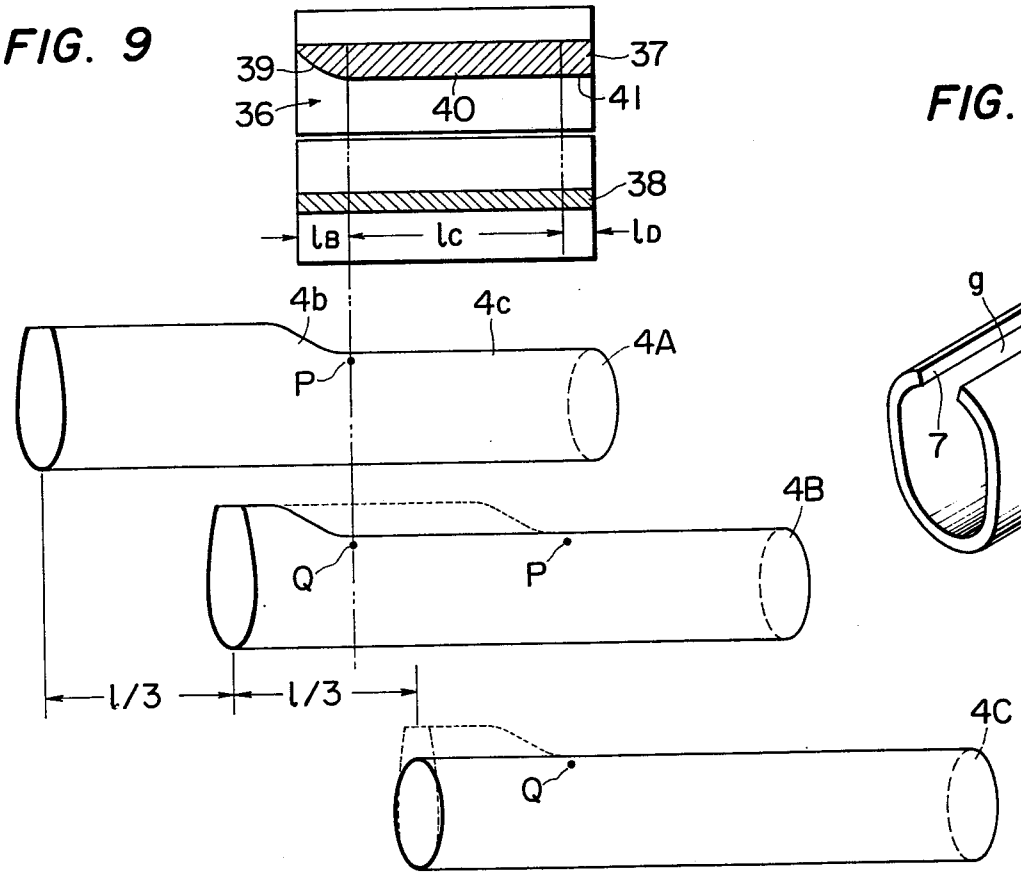
FIG. 9 is a schematic drawing showing the process for forming the U-shaped blank into an O-shaped cross-section by the press shown in FIGS. 8*a* and 8*b;*

The method of forming the U-shaped blank (1C) into the O-shape cross-section by the press having the foregoing construction will now be described. FIG. 9 shows the process schematically. First, with the parts of the die 36 open, and the U-shaped blank is positioned in the press (31) with the right end in the vicinity of the right end of the die (36). Then the parts of the die are closed by the pressure cylinders 33 and the blank is shaped by the die (36). The portion of the blank (4*c*) in the finish forming area (40) of the die (36) is formed into a cylindrical shape, but the portions (4*b*) at the transitonal forming area (39) is first formed so that the cross-section is oval since the top die (37) has the shape as described above. The die 36 is then opened and the finished portion 4*c* of the blank, as shown in FIG. 9 at (4A) and which has a length corresponding to the length of the finish forming area (40) of the die (36) is advanced by the roller table (42). The portion of the blank 4*b* from the transitional area of the die moves into the final forming area, and when the die 36 is closed again the shape is as shown at 4B. By successive shaping and ward feeding as described in the foregoing a complete cylindrical tube as shown at (4C) can be obtained. In this embodiment, the length (lc) of the finish forming area (40) of the die (36) is ⅓ of the length l of the blank, and therefore the pipe can be considered as being formed into the O-shape cross-section in three steps.

The re-forming area (41) having length (lD) is provided at the exit end of the finish forming area (40) as described in the foregoing. The right end P of the transitional portion of the blank after the forming of the first third of the blank is as shown in FIG. 9, and it is positioned at the left end of the re-forming area (41) after the forming of the third step. A similar process takes place with respect to the front end Q of the next third of the blank, and the portion of each part of the blank adjacent the next portion is compressed and formed a second time respectively by the reforming area 41 having the length (lD). As a result the gap along the seam of the O-shaped blank is not changed in the longitudinal direction, and becomes uniform. This is necessary for performing the welding smoothly.

Figure 10:
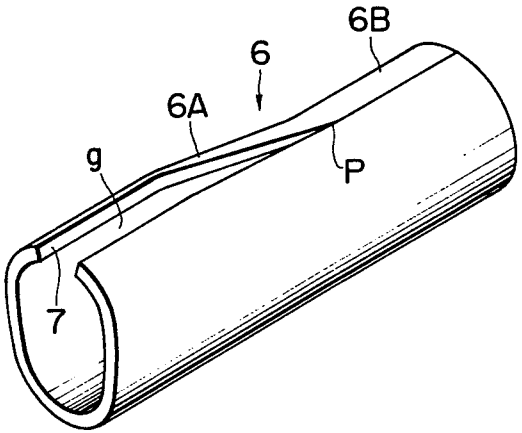
FIG. 10 is a perspective view showing a blank partly formed into an O-shape cross-section.

FIG. 10 shows the area (6) of the blank including the area (6A) which is the transitional area the cross-sectional shape of which approaches the round shape from the U-shape toward the leading end of the blank and the gap (g) between the two edges (7) is gradually narrowed. The transitionally area (6A) is formed by the finish forming area (40), and it reduces the bending of the edges (7) to a small value. As a result, a cylindrical pipe having satisfactory shape can be obtained. However, in this single die system, since multistep forming of the U-shaped blank is performed with only one die, the strain generated by the bend forming at the edge portion of the blank at the point of contact (P) at the inlet end of the finish forming area becomes large unless the length of the transitional forming area is made long, and therefore unless the proper compression strain is applied in the peripheral direction of the pipe, there is the danger that a slight depressed portion will be formed at the point P between the transition area (6A) and finish formed area (6B) of the blank during the process of the multistep forming in the single die system.

Next, the double die system will be described.

Figure 11A:
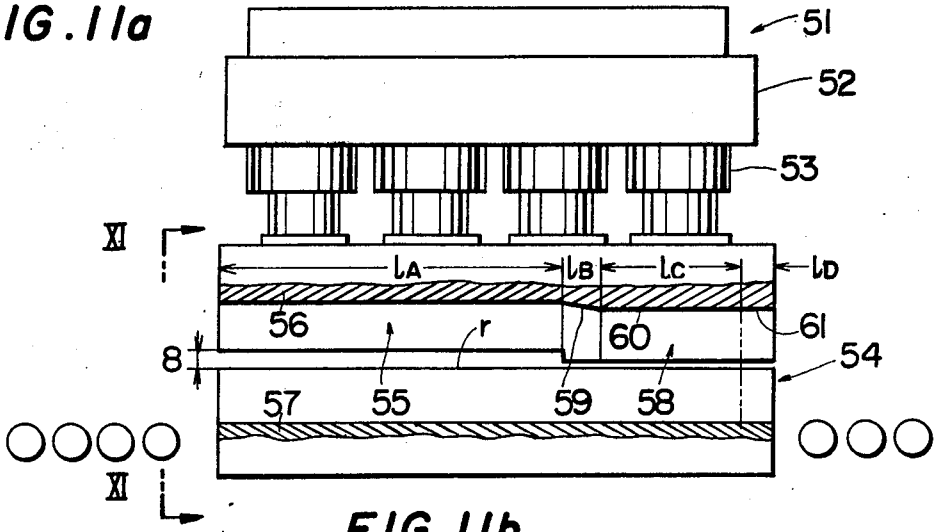
FIG. 11*a* is a side elevation, partly in section, showing another embodiment of the press of the present invention.
Figure 11B:
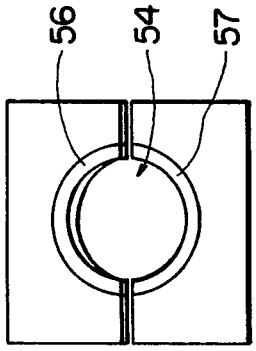
FIG. 11*b* is a front elevation view taken along line XI—XI of FIG. 11*a;*

FIGS. 11*a* and 11*b* show a major portion of the press (51) employed in the double die system for forming the blank into an O-shape, and the hydraulic pressure unit (52) and hydraulic pressure cylinders (53) provided in the apparatus are identical with those of the press (31) shown in FIG. 8, so the description thereof is omitted.

The die (54) is composed of the rough forming die portion (55) and )-shape forming die portion (58). The rough forming die portion (55) is for forming the U-shaped blank roughly to almost an O-shaped cross-section namely, to a degree where there is a slight gap between the edges. The top die (56) and the bottom die (57) of the rough forming die portion (55) each have a semi-circular shape with the same radius, but the top die (56) is positioned at a level higher than the center line (r) of the O-shape forming die portion (58) by an amount δ. The distance (δ) is about, for example, 10 mm, and since the top die (56) is spaced above the center line by the distance (δ), the gap between edges of the rough shaped blank for a blank for a finished pipe of a diameter of 1,000 mm and a wall thickness of 30 mm is about 20 mm.

The O-shape forming die (58) is composed of a transitional forming area (59), a finish forming area (60), and a re-forming area (61), all having a shape similar to the die (refer to FIGS. 8*a* and 8*b*) of the single die system.

Figure 12:
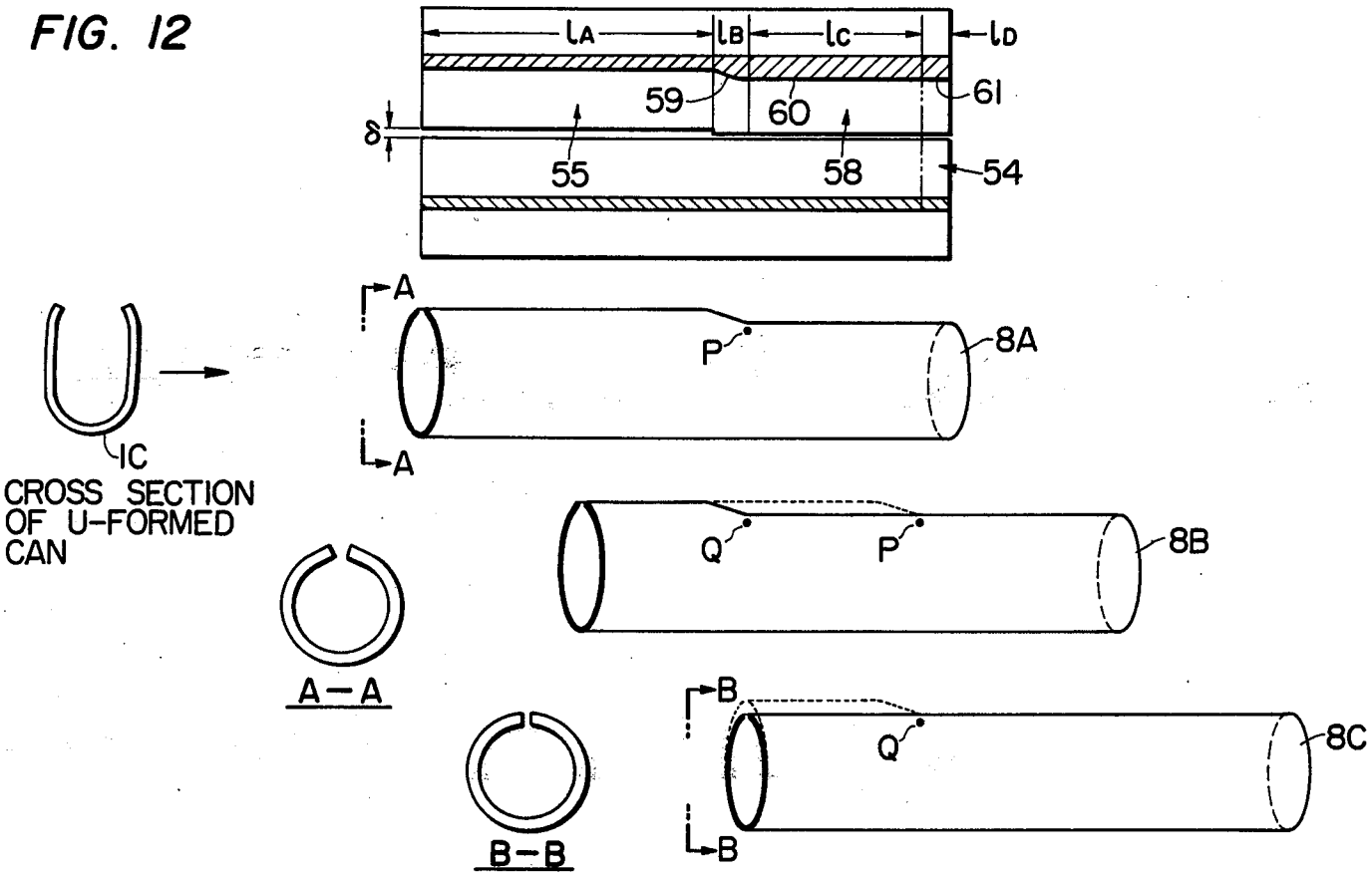
FIG. 12 is a schematic drawing showing the process of forming the U-shaped blank into an O-shaped cross-section by the press of FIGS. 11*a* and 11*b;*

The lengths of the respective portions of the double die for the multistep forming by the double die are lA, lB, lC and lD, $lC \geqq l/n$, $lB \approx (0.1\text{–}0.2)D$, $lD \approx (0.3\text{–}1.0)D$, $lA = l - (lB + lC + lD)$ relative to the length l and outside diameter D of the pipe, and n is a positive integer, and designates the number of portions of the double die in this case 4. In carrying out forming method with the double die, as shown in FIG. 12, with the parts of the die 54 separated, the leading end of the U-shaped blank (1C) is first placed even with the right or exit end of the O-shape forming die 58 and the die parts are closed by the hydraulic pressure with 52 and pressure cylinders 53 to the shape of the blank 1C into a blank 8A having a rough O-shape at the trailing end and into an O-shape at the leading end. The transition area (86) is formed between the rough O-shaped area and O-shaped area. Next, the die 54 is opened and the pipe is advanced a distance corresponding to the length c, and the parts are again closed to carry out forming in a manner similar to the first step, whereby a blank (8B) including the rough O-shaped area and the transitional area is obtained. Similarly, a third forming is carried out, and the blank 8C which is completely formed into an O-shape is obtained.

In this system, as will be obvious from the graph of FIG. 6, in the finish forming area (60) of the die (58), a large forming load must be applied the blanks (8A), (8B) and (8C). The, the forming load will now be described more concretely. The maximum forming load exerted by the dies is represented by the following equation (4) as a sum of the equation (2) for the rough forming area (55) and the equation (3) for the O-shape forming 58.

$$P_A = 1.15\ 6y.2t.lA.\alpha \quad (2)$$

$$(\alpha = \tfrac{1}{3} - \tfrac{1}{2})$$

$$Pc = 1.15\ 6y.2t.(lC + lD) \quad (3)$$

$$P = 1.15\ 6y.2t.(lA.\alpha + lC + lD) \quad (4)$$

In this die, the load at the transitionaly area 59 is small and may be ignored.

Figure 13:
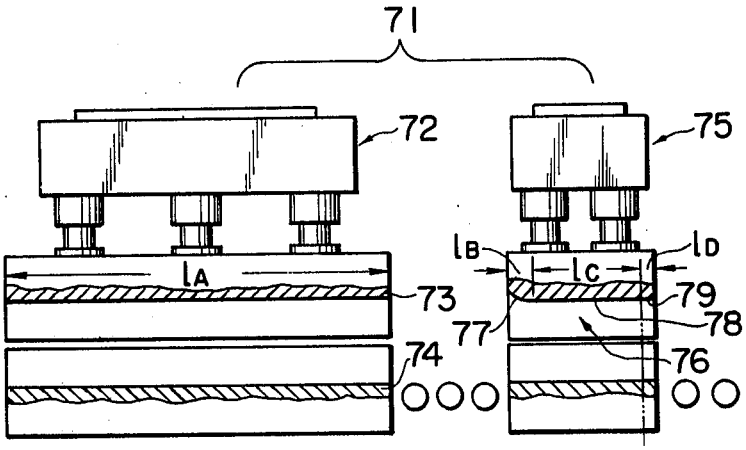
FIG. 13 is a side elevation, partly in section, showing an example of the press of the present invention which consists of a rough shaping press and a finishing press.

A forming press (71) for the double press system is shown in FIG. 13 and is composed of a rough O-shaping press (72) and an O-shaping press (75). The top die (73) and bottom die (74) of the rough O-shaping press 72 have semi-circular cross-section and the length of the die is longer than the length of the blank.

This rough O-shaping press (72) is substantially the same as a conventional O-shaping press (21) as shown in FIGS. 4*a* and 4*b*. The O-shaping press (75) is the same as the O-shaping press shown in FIGS. 8*a* and 8*b*, and the die (76) has a transitionaly forming area (77), a finish forming area (78) and a re-forming area (79). The length (lB) of the transitional forming area (77) is less than about ⅔ of the pipe diameter D, and the length (lc) of the finish forming area (78) is less than about ½ of the pipe length l. The the length (lD) of the re-forming area (79) is about 0.2 to 1.0 times the pipe diameter D.

Shaping the blank with the double press system having the foregoing construction will now be described. A U-shaped blank has the entire length shaped into a rough O-shaped cross-section as shown at A—A in FIG. 12 in a single step by the press (72), and during this step, the top die (73) is pressed down until the gap between the top die (73) and the bottom die (74) becomes (δ). By this step, the rough formed blank having a certain gap between the edges of the blank is obtained. Next, the rough O-shaped blank is formed into a finished O-shape in a series of successive forming steps by the pess (75) in the manner as described in connection with FIGS. 8*a*, 8*b* and 9, except that the blank inserted into the press (75) is the rough O-shaped blank. In the process shown in FIG. 9, the blank to be formed into the O-shape is a U-shaped blank.

In this system, the entire length of the blank is formed into a rough O-shape in a single step before the blank is formed into the final O-shape, and therefore, the rough O-shaping press 72 is required to have a large capacity similar to the double die system, but since the length of the blank which is formed into the finished O-shape in press 75 in any one step is short, satisfactory forming can be obtained with a finished O-shaping press 75, as compared with the press for the double die system.

In this multistep O-shaping method, as shown in FIG. 13, it is possible to limit the bending of the edge of the O-shaped pipe while it is being formed into the finished O-shape a small amount by having the cross-sectional shape of the inlet end of the die (76) change smoothly in the direction of the length of the blank, and as a result, an O-shaped pipe having a satisfactory shape can be obtained.

The effect of the multistep shaping method rising the double press system is as follows. The rough O-shaping is completed with a load of about ⅓ to ½ that required for finish O-shaping the entire length of the blank in a single step as shown in (1), and the load for finish O-shaping will also be about ⅓ the value of equation (1) since the length of the blank fored in any one step short is, for example, 1/3. Accordingly, when the method using the double press sytem is compared with the conventional O-shaping method, the shaping of a very heavy wall thickness blank can be carried out by press means having a capacity for forming a much smaller wall thickness blank by the prior art method.

Finally, the divided die press sytem will be described.

Figure 14:
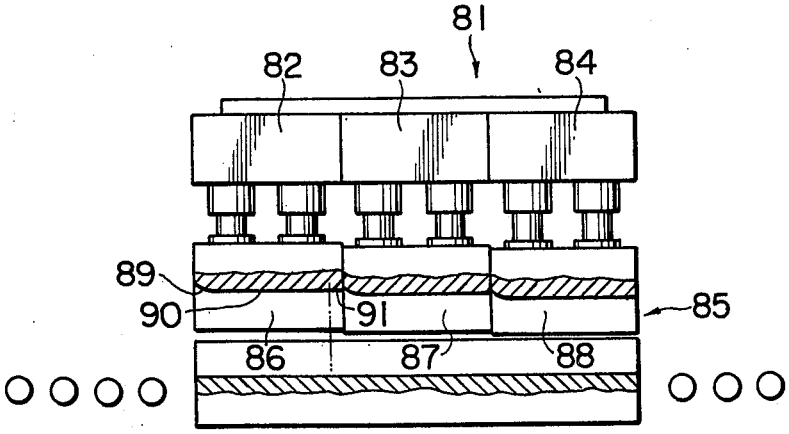
FIG. 14 is a side elevation, partly in section, showing an example of the press of the present invention which is provided with successive dies consisting of a rough shaping die, a middle forming die and a finishing die.

FIG. 14 shows an embodiment of a press for carrying out forming by the divided die press system. As shown in this drawing, the die (85) of the O-shaping press (81) is divided into a rough O-shaping die (86), as intermediate O-shaping die (87) and finish O-shaping died (88), and the respective dies are operated by hydraulic pressure units (82), (83), and (84). Also, each die (86), (87), (88) has the same shape, and is substantially the same as the die (36) shown in FIGS. 8*a* and 8*b*, and is composed of the transitonal forming area (89), finish forming area (90) and re-forming area (91). The total length of the die (85) is less than the length of the pipe to be formed, and the number of parts of the die (85) is from 2 to 4 parts.

Figure 15:
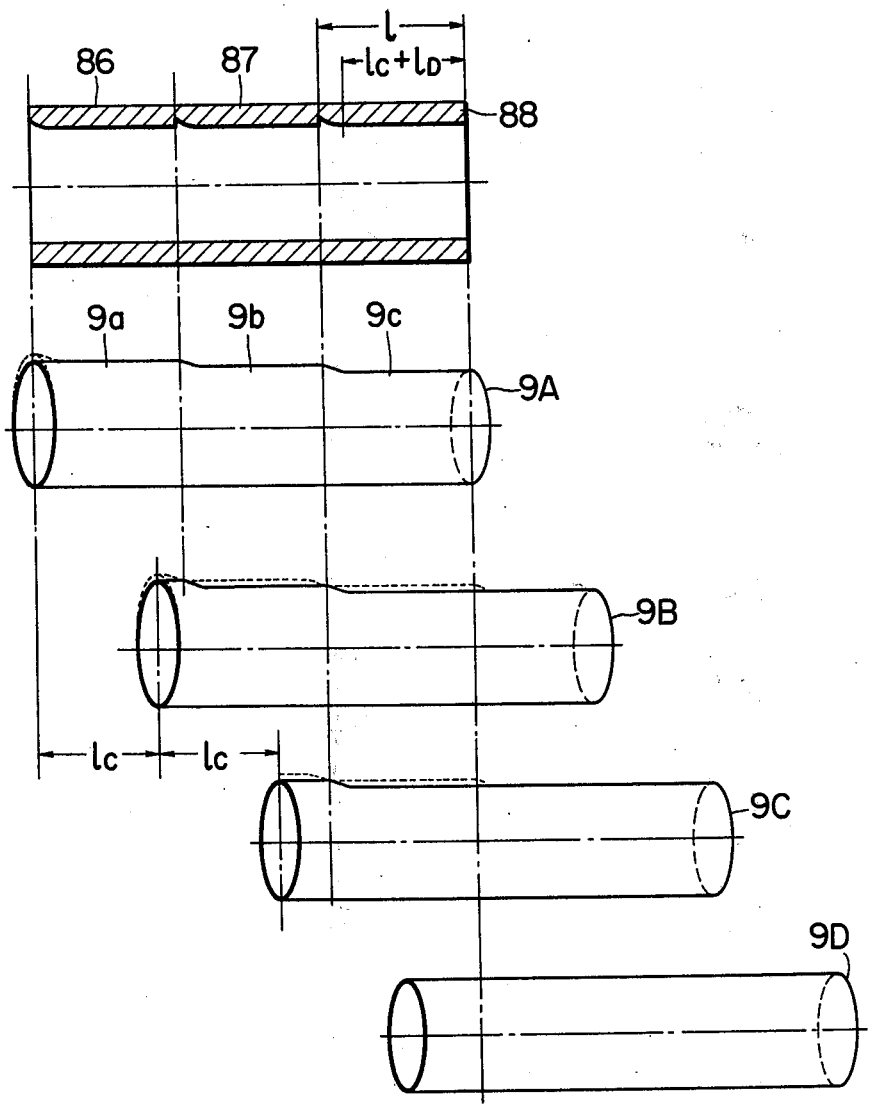
FIG. 15 is a schematic drawing showing the process of forming the U-shaped blank into an O-shaped cross-section by the press of FIG. 14.

FIG. 15 shows the condition of the blank during the various steps of the process of forming the U-shaped blank into an O-shape by the O-shaping press. In the drawing, with the parts of the die open, the U-shaped blank is inserted into the die (85) with the right end substantially alinged with the right end of the die (85), and then the parts of the die (85) are closed to form the blank into the generally O-shaped blank (9A). At this time, the gap between the top die and botto die in each die (86), (87), and (88) becomes gradually smaller in the order from the rough O-shaping die (86), the O-shaping die (87) and the finish O-shaping die (88) as shown in FIG. 14. For example, in the case of the pipe having a diameter of 1,000 mm and a wall thickness of 30 mm, the gap between the parts of rough O-shaping die (86), is 20 mm, and the gap between the parts of the intermediate O-shaping die (87) is 10 mm, and the gap between the parts of the finish O-shaping die (88) is 0 mm. Accordingly, the gap between the edges of the blank in the left end portion (9*a*) (portion shaped by the rough O-shaping die (86)) of the blank (9A) is relatively large, (for example, 40 mm), the gap in the intermediate portion (9*b*) is somewhat smaller, and in the right portion (9*c*), the gap is almost 0 mm.

When the O-shaped blank (9A) has been formed, the die 85 is opened and the blank is advanced rightward a distance equal to the lc and ld corresponding to the finish forming portion of the die (85), and then the next shaping process is carried out. In this way, the O-shaped blanks (9B) and (9C) are sequentially obtained, and finally, a pipe which has a completely circular cross-section over the entire length is obtained.

The adjacent side surfaces of the dies (86), (87) and (88) are preferably in mutual contact. When the gaps between the side surfaces of the adjacent dies are large, the portion of the pipe positioned in this gap is slightly bulged into the gap, and the difficulty of finish forming by the finish forming die will increase.

Also, 3 the three parts of the O-shaping press are set for their maximum operating loads, and the loads become gradually larger in the succeeding steps as will be obvious from the graph of FIG. 6. The parts of the O-shaping press presses start operations simultaneously and carry out the forming at equal speeds and reach the predetermined loads sequentially from the left to the right in the Figures and stop their operations.

An example of the forming load while performing multistep forming by the systems according to the double die system and double press system is described in the following. An X-60 class steel pipe having a plate thickness of 30 mm and an outside diameter of 30" and a length of 18 m is formed, the lengths of the parts of the die are 1A=11.5m, 1B=0.5m, and 1C=6*m*, and the gap $\delta$ between the upper and lower halves of the portions (8*a*) and (8*c*) (refer to FIG. 12) is 40 mm, was formed by the double press system in 3 steps (n=3).

The forming load in the conventional method for these forming conditions is calculated as 55,890 ton from the equation (1) (assuming that $6y=45$ kg/mm$^2$).

The forming load for the first step according to the method of the present invention was about 31,000 tons. This value is close to the value of 30,530 ton obtained on the basis of $\alpha=\frac{1}{3}$ in the equation (4), and the load is lower by 44% compared with that of the conventional method. When using the double press system to form the same plate, a satisfactory shape can be obtained with a rough O-shaping load of 27,900 tons and finish O-shaping load of 18,600 tons.

As described in the foregoing, multistep O-shaping method according to the present invention makes possible the forming of an O-shape cross-section pipe at a load of about 2/3–4.5 that of the conventional method by employing one or two units in the O-shaping presses.

Accordingly, in comparison with the conventional forming method, the forming heavy wall thickness O-shaped cross-section pipe can be carried out a press having a small capacity, and the range of size of the pipes which can be manufactured can be greatly expanded.

What is claimed is:

1. A method of manufacturing metal pipe comprising the steps of bending the edges of a metal plate up slightly, further bending the thus bent plate into a U-shape cross-section blank, finish forming the U-shape blank into an O-shaped blank with the longitudinal edges opposed to each other in position for welding by placing one end of the U-shaped blank into at least one two-part die the parts of which are movable toward and away from each other and having at least one portion with the shape of the opposed die recesses defining a reforming area on one end of the die portion which has an O-shaped cross-section, a finish forming area in the middle of the length of the die portion having an O-shaped cross-section, said O-shaped cross-sections being in the shaped of the O-shaped blank, and a transitional area at the other endof the die portion having a cross-sectonal shape which changes gradually from an O-shape adjacent the finish forming area to an oval shape elongated in the direction of movement of the die parts at the other end of the die portion, the transitional area being relatively short as compared to the remainder of the die parts, said at least one die portion being shorter than the length of the blank, the U-shaped blank being placed in the die with the elongated dimension of the oval shape and with one end of the blank at said one end of said die portion, closing the two part die by moving the parts toward each other for shaping the U-shaped blank into a blank having an O-shaped cross-section reformed portion on said one end of the blank, a finished O-shaped cross-section and a transitional section, opening the two part die by moving the parts away from each other, moving the thus formed blank along the die until the edge of the transitional section of the blank is at the end of the finished forming area of the die portion adjacent the reforming area, again closing the die, repeating the steps of the positioning the blank and opening and closing the die until the blank is completely formed into an O-shaped cross-section, and welding the opposed edges of the plate to produce the O-shaped cross-section blank.

2. The method as claimed in claim 1 further comprising the step of rough shaping the U-shaped blank into a rough O-shaped cross-section blank prior to placing the blank into the said die portion.

3. The method as claimed in claim 2 in which said rough shaping is carried out by using a rough-shaping die positioned ahead of, relative to the direction of moving the blank, the said at least one two part die.

4. The method as claimed in claim 2 in which said rough shaping is carried out using a rough-shaping die portion forming the remainder of said at least one die and which is integral with said at least one die portion and on the end ahead of, relative to the direction of moving the blank, said at least one die portion.

5. The method as claimed in claim 1 in which the said two part die has a plurality of adjacent and successive portions each having said finish forming area, O-shaped cross-section area and transitional area, and the step of closing the two part die comprises closing the die portion at said one end of the die until the parts substantially abut each other for finish forming the leading end, in the direction of moving the blank, of the blank, and closing the die portions preceding the die portion at said one end of the blank to successively less degrees for rough shaping the portions of the blank not in the die portion at said one end of said die.

6. An improved die means for an apparatus for manufacturing an O-shaped cross-section blank for a metal pipe from a U-shaped cross-section blank and having die means and die actuating means for actuating said die means, said improved die means comprising at least one two-part die, the parts of which are movable toward and away from each other by said die actuating means, said two-part die having at least one portion with the shape of the opposed die recesses defining a reforming area on one end of the die portion which has an O-shaped cross-section, a finish forming area in the middle of the length of the die portion having an O-shaped cross-section, said O-shaped cross-sections being the shape of the O-shaped blank which is to be formed, and a transitional area at the other end of the die portion having a cross-sectional shape which changes gradually from an O-shape adjacent the finish forming area to an oval shape elongated in the direction of movement of the die parts at the other end of the die portion, the transitional area being relatively short as compared to the remainder of the die parts, said at least one die portion being less than half the length of the blank to be formed.

7. An improved die means as claimed in claim 6 further comprising a rough shaping die portion integral with said one portion of the two part die on the end on which said transitional area is located, said rough shaping die portion having opposed semi-circular cross-section die recesses therein which, when the die parts are in the closed position closest to each other define a roughly O-shaped cross-section.

8. An improved die means as claimed in claim 6 further comprising a separate rough shaping press spaced from the end of said two part die at which said transitional area is located, said rough shaping press having a two part die with a shape for defining a roughly O-shaped cross-section and means further having means for actuating said two part die.

9. An improved die means as claimed in claim 6 in which there is at least two of said two part dies in succession each having the same shape, the first of said two part dies being closable to a degree less than the second two part die to define between the finish forming areas thereof a roughly O-shaped cross-section.

* * * * *